US008474675B2

(12) United States Patent
Haehnel et al.

(10) Patent No.: US 8,474,675 B2
(45) Date of Patent: Jul. 2, 2013

(54) DEVICE FOR AUTOMATICALLY CONTROLLING THE EDGES OF A WEB OF SHEETING

(75) Inventors: Bernd Haehnel, Stutensee (DE); Werner Goetz, Achstetten (DE); Roland Benz, Schemmerhofen (DE)

(73) Assignee: Uhlmann Pac-Systeme GmbH & Co. KG, Laupheim (DE)

( * ) Notice: Subject to any disclaimer, the term of this patent is extended or adjusted under 35 U.S.C. 154(b) by 553 days.

(21) Appl. No.: 12/727,214

(22) Filed: Mar. 18, 2010

(65) Prior Publication Data

US 2010/0249985 A1 Sep. 30, 2010

(30) Foreign Application Priority Data

Mar. 25, 2009 (EP) ..... 09156125

(51) Int. Cl.
*B65H 23/038* (2006.01)

(52) U.S. Cl.
USPC ..... 226/19; 226/3

(58) Field of Classification Search
USPC ..... 226/3, 19, 20
See application file for complete search history.

(56) References Cited

U.S. PATENT DOCUMENTS

| | | | | | |
|---|---|---|---|---|---|
| 1,875,777 | A | * | 9/1932 | Tackaberry | 26/78 |
| 2,332,104 | A | * | 10/1943 | Meyer | 226/20 |
| 2,548,590 | A | * | 4/1951 | Cook | 356/637 |
| 2,786,675 | A | * | 3/1957 | Montefalco et al. | 226/20 |
| 3,052,395 | A | * | 9/1962 | Scott | 226/190 |
| 3,069,921 | A | * | 12/1962 | Davis | 474/103 |
| 3,116,244 | A | * | 12/1963 | Davis et al. | 210/401 |
| 3,370,771 | A | * | 2/1968 | Shay | 228/8 |
| 3,373,912 | A | * | 3/1968 | Toensing | 226/20 |
| 3,490,674 | A | * | 1/1970 | Ott, Jr. et al. | 226/19 |
| 4,545,516 | A | * | 10/1985 | Miyai | 226/20 |
| 4,848,632 | A | * | 7/1989 | Mack et al. | 226/18 |
| 5,094,442 | A | * | 3/1992 | Kamprath et al. | 271/227 |
| 5,947,617 | A | | 9/1999 | Kondo | |

FOREIGN PATENT DOCUMENTS

| | | | |
|---|---|---|---|
| EP | 1013584 | A | 6/2000 |
| GB | 2226774 | A | 7/1990 |
| WO | WO 2004/035922 | A | 4/2004 |

* cited by examiner

*Primary Examiner* — Sang Kim
*Assistant Examiner* — Scott Haugland
(74) *Attorney, Agent, or Firm* — Brinks Hofer Gilson & Lione

(57) ABSTRACT

A device for automatically controlling the edges of a web of sheeting has a first deflecting roller and a second deflecting roller, which are arranged parallel to each other, and also a drive for shifting the deflecting rollers in opposite axial directions. A sensor detects the position of the sheeting. The drive shifts the deflecting rollers in opposite axial directions and the ratio between the friction of the sheeting on the first deflecting roller and the friction of the sheeting on the second deflecting roller is changed on the basis of the position of the sheeting detected by the sensor.

7 Claims, 7 Drawing Sheets

DEVICE FOR AUTOMATICALLY CONTROLLING THE EDGES OF A WEB OF SHEETING

CROSS-REFERENCE TO RELATED APPLICATIONS

The present patent document claims the benefit of priority to European Patent Application No. EP 09156125.8, filed Mar. 25, 2009, and entitled "DEVICE FOR AUTOMATICALLY CONTROLLING THE EDGES OF A WEB OF SHEETING," the entire contents of each of which are incorporated herein by reference.

FIELD OF THE INVENTION

The invention relates to a device for automatically controlling the edges of a web of sheeting, especially when guiding the sheeting through blister machines of the pharmaceutical industry.

BACKGROUND OF THE INVENTION

Devices of this type for automatically controlling the edges of webs of sheeting in blister machines have been known for a long time. In the production of blister packs, a forming sheet and a cover sheet are sealed together in a blister machine, wherein pockets, which are filled with the pharmaceutical products, are formed beforehand in the forming sheet. To guide the sheets, i.e., the forming sheet and the cover sheet, a web edge control system is required, because, as the sheets are being transported through the machine, they have the tendency to move transversely to the main travel direction. This tendency is caused by deviations in the parallelism of the deflecting rollers and guide rollers and also by inaccuracies in the cutting of the rolls of forming sheet or cover sheet.

To control this movement of the sheets, the forming sheet has up to now been guided transversely to the travel direction by two guide plates located at the last deflecting roller before the forming station.

When a sensor provided for this purpose sends a signal that the forming sheet threatens to leave the tolerance range, a motor pushes the guide plates transversely to the sheeting travel direction to correct the direction in which the sheeting is traveling.

Especially in the case of sheetings of aluminum foil, the use of lateral guide plates to shift the sheeting can lead to a situation in which the sheeting does not follow the movement of the guide plates. Instead, the edges of the sheeting climb up the guide plates and fall back on themselves.

This problem does not exist to the same degree in the case of sheets of PVC because of their greater stiffness, but fine dust abraded from the PVC does accumulate on the guide plates.

BRIEF SUMMARY OF THE INVENTION

It is an object of the present invention to provide a device for automatically controlling the edges of a web of sheeting by means of which, in a small space and in a simple, reliable, and nondamaging manner, the edges of webs of any type of sheeting can be automatically controlled.

According to one aspect of the invention, the device for automatically controlling the edges of a web of sheeting comprises

- a first and a second deflecting roller, which are arranged parallel to each other,

- at least one drive for shifting the deflecting rollers in axially opposite directions,
- a sensor for detecting the position of the sheet,
- a means for changing the ratio between the friction of the sheeting on the first deflecting roller and the friction of the sheeting on the second deflecting roller, and
- an automatic control device for controlling the at least one drive for shifting the deflecting rollers in axially opposite directions and for controlling the means for changing the ratio between the friction of the sheeting on the first deflecting roller and the friction of the sheeting on the second deflecting roller on the basis of the position of the sheeting detected by the sensor.

With the use of this design, it becomes possible to control reliably the edges of webs of any desired type of sheeting, wherein positively-acting guide elements which suffer from the disadvantages described above do not have to be used. As a result, it is possible to control the edges of the web continuously and yet in a manner which is extremely protective of the sheetings.

In a first embodiment, the deflecting rollers are arranged next to each other in the axial direction in such a way that the sheeting moves widthwise over at least one section of each of the two deflecting rollers. As a result of this two-part division of the contact surface for the sheeting, it becomes easy to influence the friction between the sheeting and each of the deflecting rollers.

The deflecting rollers are preferably supported on the same shaft, which comprises a first thread in the area of the first deflecting roller and a second thread in the area of the second deflecting roller, wherein the first thread and the second thread turn in opposite directions, and wherein the drive for shifting the deflecting rollers in axially opposite directions drives the shaft. As a result of this design, it is especially easy to control the shifting of the deflecting rollers in axially opposite directions by means of a single drive.

To influence the friction between the sheeting and each deflecting roller, the means for changing the ratio between the friction of the sheeting on the first deflecting roller and the friction of the sheeting on the second deflecting roller comprises two pressure rolls, the first of which is assigned to the first deflecting roller, the second of which to the second deflecting roller.

Each pressure roll can preferably be shifted in the axial direction simultaneously with the associated deflecting roller. In this way, the sheeting can be shifted laterally by the combination of the pressure which the pressure roll exerts against the sheeting and thus against the associated deflecting roller and the simultaneous lateral displacement of the deflecting roller and the pressure roll.

Each pressure roll is preferably connected to the associated deflecting roller in such a way that the drive for shifting the deflecting rollers in axially opposite direction can shift each of the pressure rolls simultaneously with the associated deflecting roller. Thus, in a simple manner, the synchronicity of the movement of the deflecting roller and the associated pressure roll is ensured.

In a second embodiment, the deflecting rollers are arranged next to each other in the radial direction in such a way that the sheeting passes over only one deflecting roller, wherein each deflecting roller comprises its own shaft. With this design, it is possible to process sheetings which have a relatively high retraction force.

In this case, the two shafts preferably comprise oppositely-directed threads, and the drive for shifting the deflecting rollers in axially opposite direction drives both shafts simultaneously. Alternatively, a drive can be provided for each shaft.

The means for changing the ratio between the friction of the sheeting on the first deflecting roller and the friction of the sheeting on the second deflecting roller preferably comprises a bearing for the shafts which is designed with freedom to pivot. As a result, it is possible in a simple manner to change over from the case in which the sheeting is traveling over one shaft to the case in which the sheeting is traveling over the other shaft.

Although there are many possible designs, it is preferable for the first deflecting roller to be slightly farther away from the pivot axis than the second deflecting roller is. In particular, if the bearing is now free at the same time to pivot around an angular distance of between 92° and 105°, and preferably between 93° and 98°, the bearing can be easily pivoted between two positions in which there is a connection between only one deflecting roller and the sheeting.

In all of the embodiments, it is advantageous to provide at least one sensor to detect the end positions of the travel of each deflecting roller, wherein the sensor is connected to the automatic control device. Thus the rotational direction of the drive for shifting the deflecting rollers in opposite axial directions can always be changed at the correct time.

BRIEF DESCRIPTION OF THE DRAWINGS

Additional features and advantages of the present invention can be derived from the following description, which refers to the drawings.

DETAILED DESCRIPTION OF THE INVENTION

Figure 1:
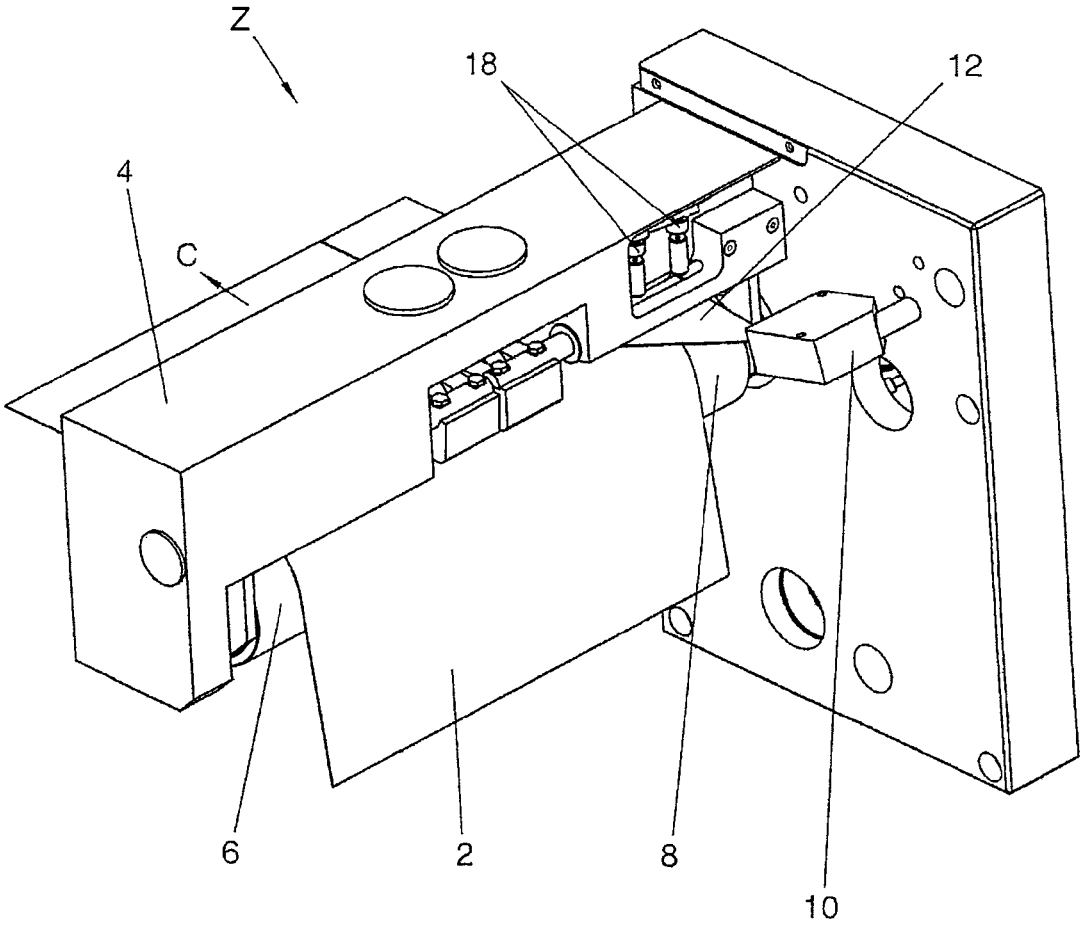
FIG. 1 is a schematic perspective view of a first embodiment of the device for automatically controlling the edges of a web of sheeting.

FIGS. 1-4 show a first embodiment of the device for automatically controlling the edges of a web of sheeting according to the invention. The types of sheeting which can be used include in particular the forming sheets for blister packs, but the invention is also applicable to cover sheets for blister packs and to many other types of sheeting used in other industries.

The device for automatically controlling the edges of a web of sheeting 2 comprises a housing 4, in which a first deflecting roller 6 and a second deflecting roller 8 are arranged parallel to each other. In the first embodiment shown in FIGS. 1-4, the deflecting rollers 6, 8 are arranged next to each other in the axial direction in such a way that the sheeting 2 passes widthwise over at least one section of each of the two deflecting rollers 6, 8. The width of the sheeting 2 should be less than the total width of the two deflecting rollers 6, 8. The sheeting 2 is taken from a roll (not shown), is deflected over the deflecting rollers 6, 8, and sent onward to other processing stations (heating station, forming station) in the direction of arrow C. The deflecting rollers 6, 8 have a lateral surface consisting of, for example, plastic. A certain frictional force is generated between the lateral surface and the sheeting 2 to be conveyed.

A sensor 10 (FIG. 1) detects the position of at least one lateral edge of the sheeting 2 by means of optical scanning within a visual field 12 and transmits signals to an integrated automatic control device (not shown) for controlling the edge of the sheeting 2.

The two deflecting rollers 6, 8 can rotate independently of each other and can be moved in opposite axial directions, either toward or away from each other, by a certain amount such as by about 10 mm. A motorized drive 14 is preferably used to shift the deflecting rollers 6, 8 in opposite axial directions. It is also possible to provide two separate drives 14 to shift the deflecting rollers 6, 8 in the axial direction.

In the example in FIGS. 1-4, the cores of the two deflecting roller 6, 8, i.e., the cores on which the associated lateral surfaces of the rollers turn, are supported on the same shaft 16, which is designed as a spindle. A first thread (not shown) in the area of the first deflecting roller 6 and a second, opposite thread (not shown) in the area of the second deflecting roller 8 are provided. The drive 14, which can be designed as a servo motor, for example, drives the shaft 16 and, because the threads of the two threaded sections are opposed, the deflecting rollers 6, 8 are moved in opposite axial directions. Sensors 18 can serve to detect the axial endpoints of the displacement of the deflecting rollers 6, 8.

Figure 2:
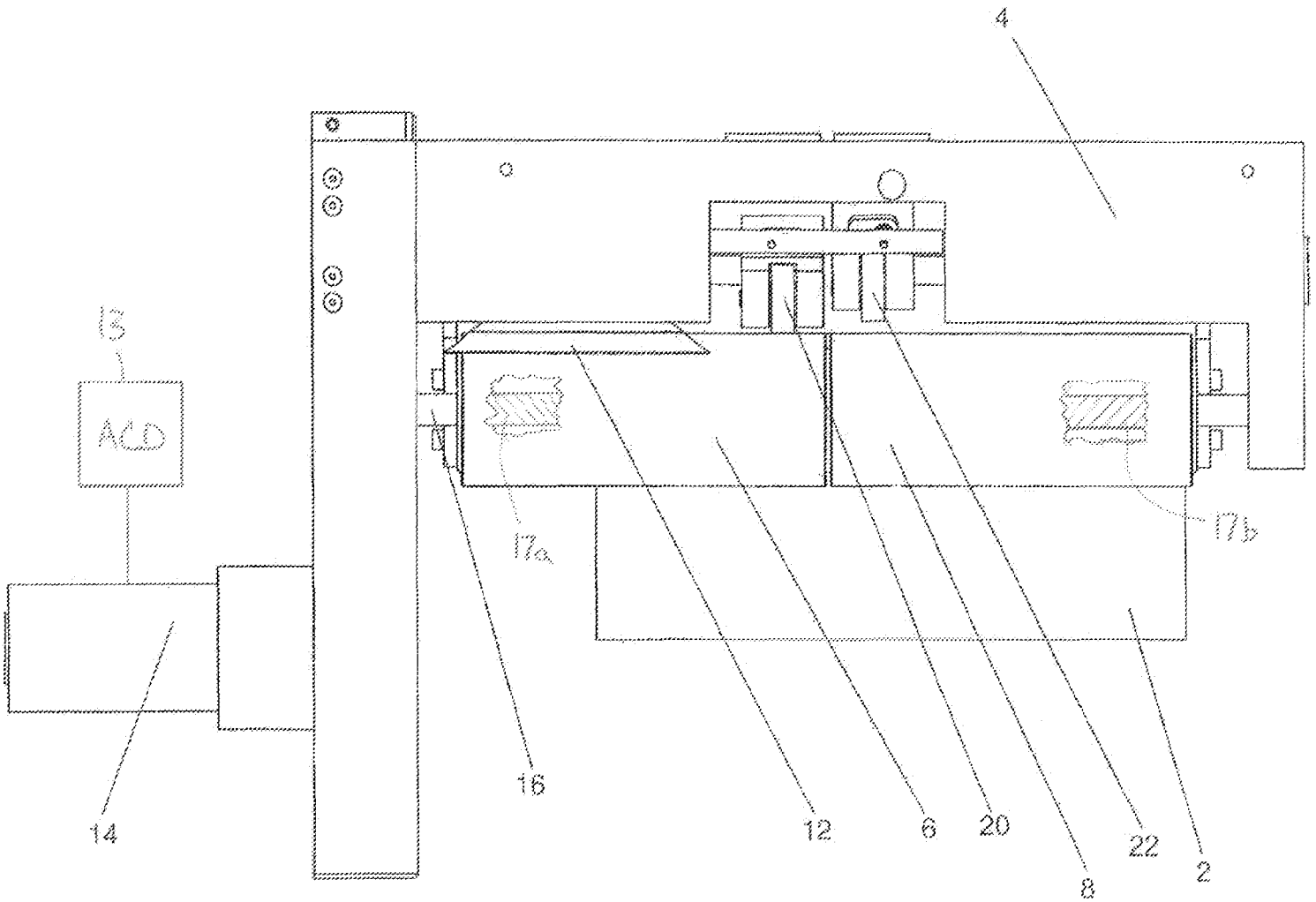
FIG. 2 is a cross-sectional view of the embodiment of FIG. 1 as seen when looking in direction Z.
Figure 3:
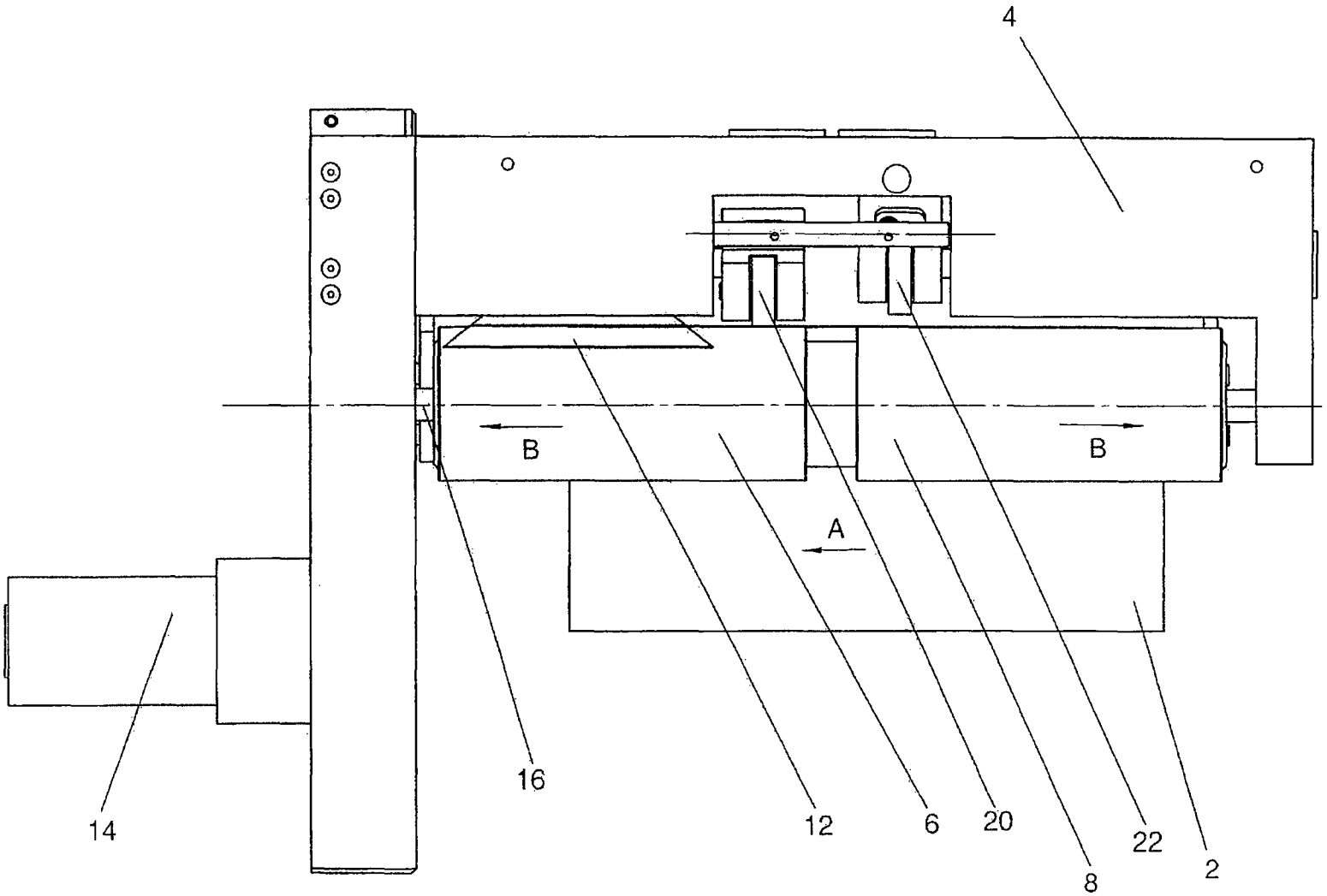
FIG. 3 corresponds to FIG. 2, except that the two deflecting rollers are in their outer end positions.
Figure 4:
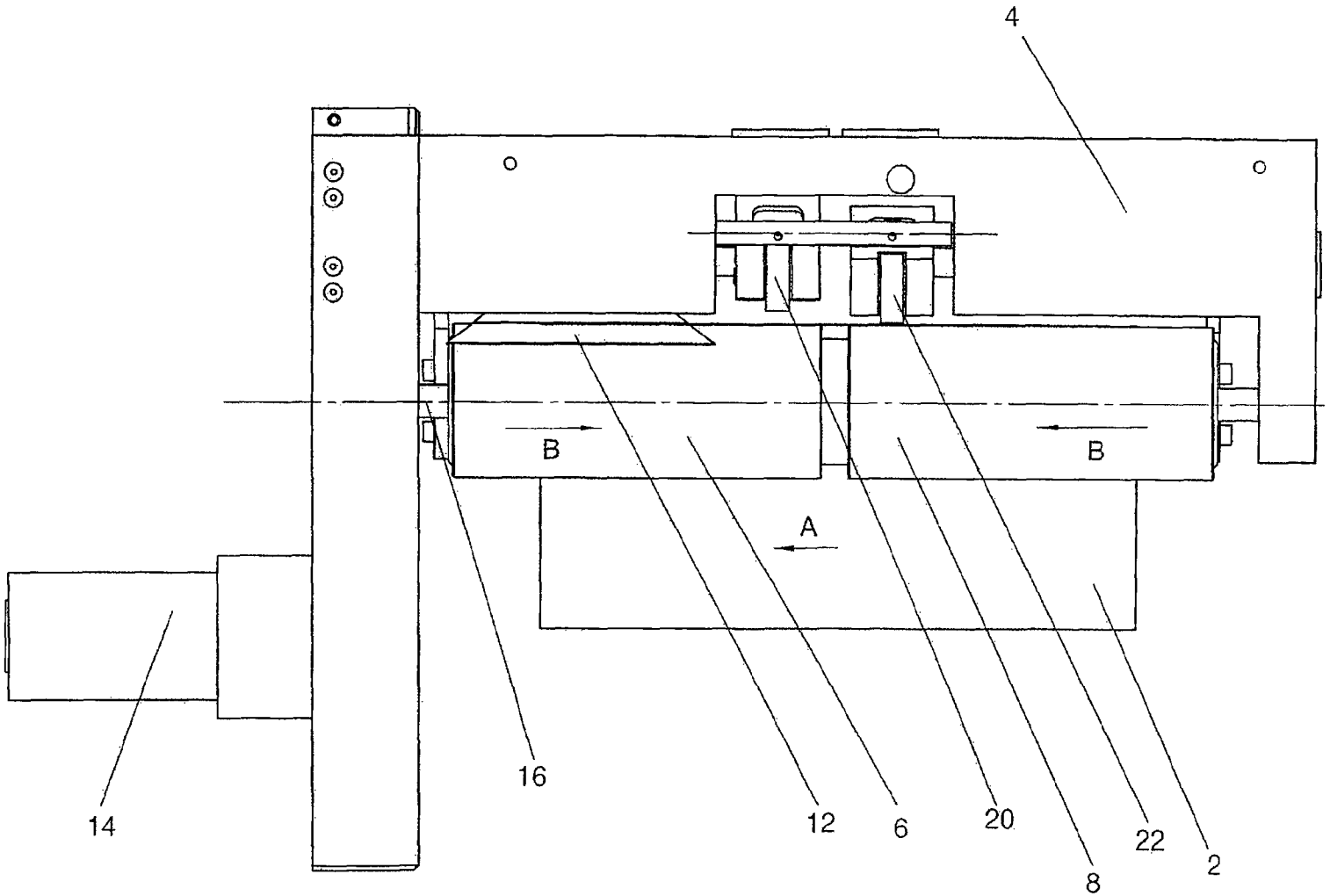
FIG. 4 corresponds to FIG. 3, wherein the deflecting rollers are on the return route to the central position.

FIG. 2 shows the situation in which the two deflecting rollers 6, 8 are as close to each other as possible. FIG. 3 shows the situation in which the two deflecting rollers 6, 8 are as far apart as possible. FIG. 4 shows an intermediate position between the two end positions.

The device comprises a means for changing the ratio between the friction of the sheeting 2 on the first deflecting roller 6 and the friction of the sheeting 2 on the second deflecting roller 8. In the case of FIGS. 1-4, this means consists of small pressure rolls 20, 22, one of which is mounted above each of the two deflecting rollers 6, 8. These pressure rolls can be pressed, preferably pneumatically, with light pressure against the associated deflecting roller 6, 8 and can be moved away from it again. Each of the two pressure rolls 20, 22 is connected axially to its associated deflecting roller 6, 8, so that each pressure roll 20, 22 executes the same axial movement as the deflecting roller 6, 8 assigned to it.

To illustrate the control principle, let the sheeting 2 be shifted by an exaggerated distance to the right, that is, in the transverse direction. The visual field 12 of the sensor 10 (FIG. 1) in the present case evaluates the left edge of the sheeting 2 and transmits the control deviation which it detects to the drive 14 via the control device. In the present example, the sheeting 2 must be moved toward the left from the position shown in FIG. 2.

For this purpose, the left pressure roll 20 is laid with light pressure against the left deflecting roller 6, and it thus generates a frictional force between the deflecting roller 6 and the sheeting 2 which is slightly higher than the frictional force between the other deflecting roller 8 and the sheeting 2.

Because the sensor 18 has also recognized that the deflecting rollers 6, 8 are as close as possible to each other in the axial direction, the automatic control device for the drive 14 will select a rotational direction such that the deflecting rollers 6, 8 move away from each other in the direction of the arrows B (FIG. 3). As the deflecting rollers 6, 8 are shifted in the axial direction, the sheeting 2 is moved toward the left, in the direction of the arrow A, along with the left deflecting roller 6 as a result of the higher frictional force being exerted on it.

FIG. 3 shows how the sheeting 2 has also moved toward the left along with the axial movement of the left deflecting roller 6. The deflecting rollers 6, 8 can be moved axially away from each other until a maximum displacement has been reached and the deflecting rollers 6, 8 are the maximum distance apart. The distance over which the deflecting rollers can be shifted can, of course, depend to a certain extent on the type of sheeting to be processed and on other boundary conditions.

In the example given here, the sheeting 2 always has the tendency to move toward the right. Because the axial movement of the deflecting rollers 6, 8 toward the outside is limited, at a certain point the ability to transport the sheeting 2 to the left by moving the deflecting rollers 6, 8 apart will be used up. This is shown in FIG. 3, in which the deflecting rollers 6, 8 have reached their maximum end positions, which is detected by the sensor 18.

Because, on the other hand, the sheeting 2 should continue to be pushed toward the left, the right pressure roll 22 is now pressed lightly against the right deflecting roller 8, whereas the left pressure roll 20 lifts off and remains free. The drive 14 changes its direction of rotation and thus has the effect that the deflecting rollers 6, 8 start to move toward each other again in the axial direction (FIG. 4). Because the friction between the right deflecting roller 8 and the sheeting 2 produced by the pressed-on right pressure roll 22 is greater than that between the sheeting 2 and the left deflecting roller 6, the sheeting 2 continues to be pushed toward the left by the right deflecting roller 8.

By the use of this principle, therefore, the control system can correct the transverse travel of the sheeting 2 in endless fashion without any loss of time and without the need to use positively-engaging guide elements.

It is also conceivable that the pressure rolls 20, 22 could be omitted in cases where the friction between the deflecting rollers 6, 8 and the sheeting 2 is relatively high. Using the pressure rolls 20, 22, is preferable, however. In the example shown here, each of the pressure rolls 20, 22 is arranged in the axially inner area of the deflecting rollers 6, 8, but they could also be located farther out in the axial direction. The lateral surface of the pressure rolls 20, 22 will usually consist of an elastic material such as rubber.

Figure 5:
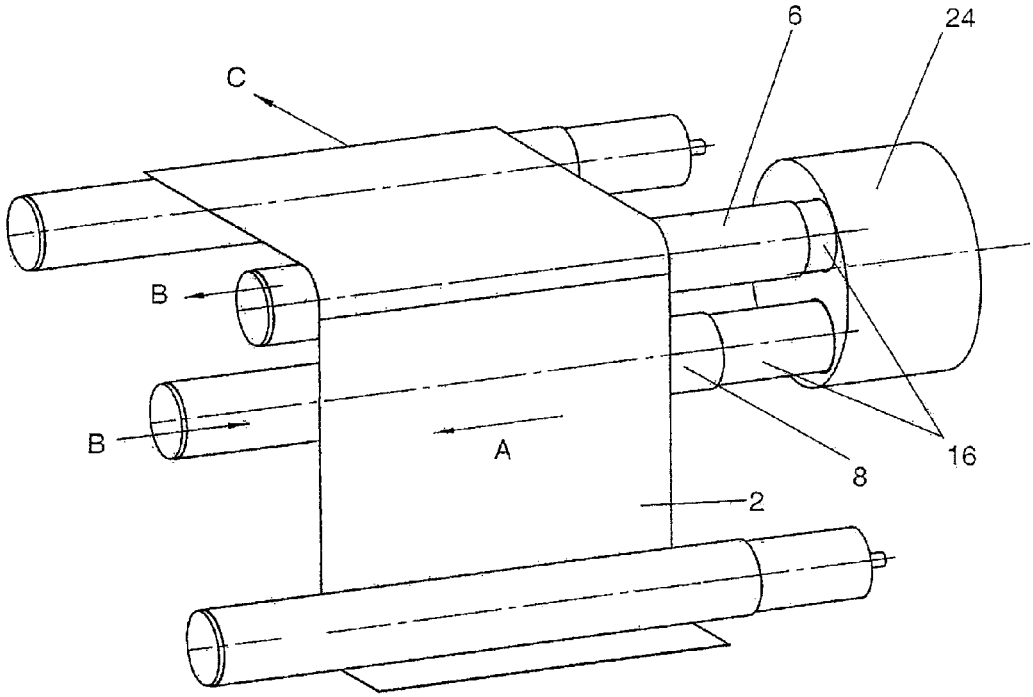
FIG. 5 is a schematic perspective view of the most important elements of a second embodiment of the device for automatically controlling the edges of a web of sheeting.
Figure 6:
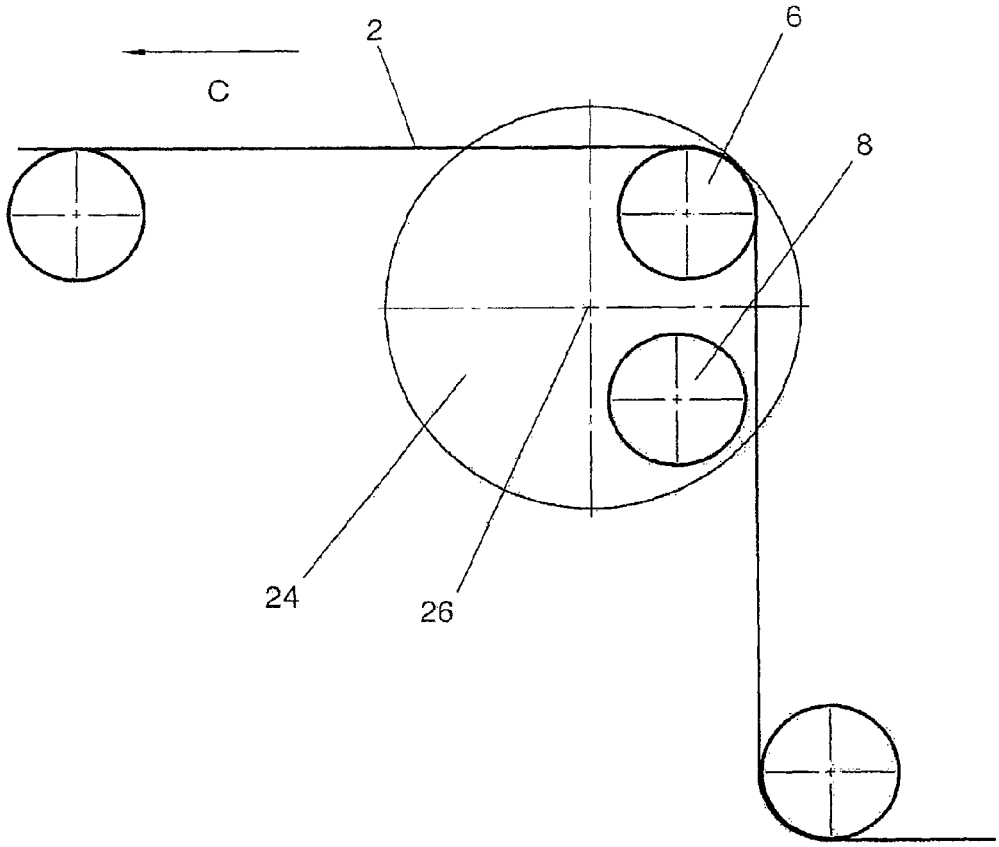
FIG. 6 is a side view of the device of FIG. 5.
Figure 7:
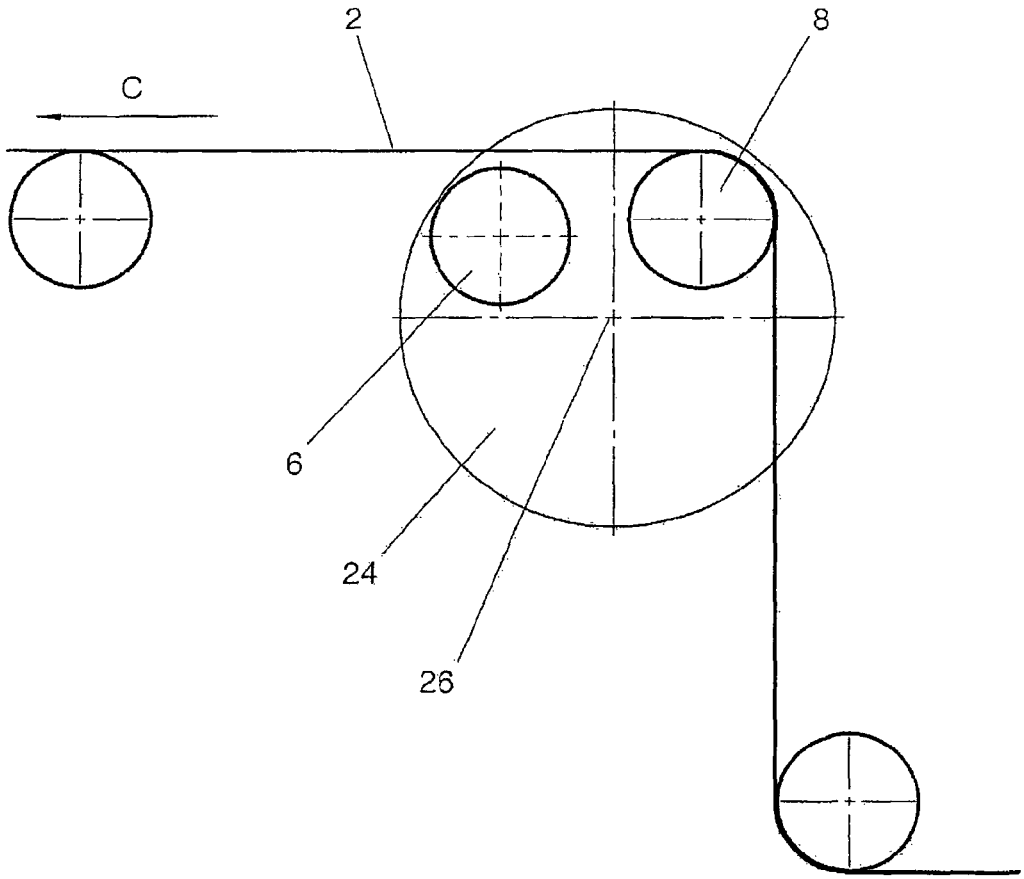
FIG. 7 corresponds to FIG. 6, wherein the bearing plate has been pivoted in such a way that the sheeting is now traveling over the second deflecting roller.

Especially for sheeting 2 with relatively high retraction force, a second embodiment of web edge control is suitable; it is shown schematically in FIGS. 5-7. The two deflecting rollers 6, 8, which are able to shift in opposite axial directions, are arranged with their axes parallel to each other and next to each other in the radial direction. The two deflecting rollers 6, 8 are again shifted in opposite axial directions by a motor in the direction of the arrows B.

As the means for changing the ratio between the friction of the sheeting 2 on the first deflecting roller 6 and the friction of the sheeting 2 on the second deflecting roller 8, a pivotable bearing 24 is used here, in which the shafts 16 of the deflecting rollers 6, 8 are supported. All of the sheeting 2 always travels over only one of the deflecting rollers 6, 8, whereas the sheeting 2 does not touch the other deflecting roller 6, 8 at all.

In FIGS. 5 and 6, for example, the deflecting roller 6 would be active and by its axial movement could shift the sheeting 2 in the direction of the arrow A. During this movement, the deflecting roller 8 moves back in the opposite axial direction without coming in contact with the sheeting 2. It is advantageous here for the first deflecting roller 6 to be slightly farther away from the pivot axis 26 than the second deflecting roller 8 is. It is also advantageous for the bearing 24 to be free to pivot around an angular distance of between 91° and 180°, preferably between 92° and 105°, and more preferably between 93° and 98°. The closer the value to 90°, the less severe the problems of sheeting guidance during the pivoting of the bearing 24.

If the adjusting distance of the deflecting roller 6 has been used up but it is still necessary to continue pushing the sheeting 2 in the same direction, the bearing 24 can execute a pivoting movement (FIG. 7), so that the sheeting 2 is guided now exclusively by the deflecting roller 8. This now again has the ability to continue to push the sheeting in the same direction (arrow A).

In the case of this embodiment as well, it would be possible to use a pressure roll to increase the friction between the deflecting roller 8, 9 and the sheeting 2.

Overall, therefore, a device for controlling the edges of a web is provided, by means of which irregularities in sheeting guidance can be corrected in a simple, reliable, and non-damaging way.

The invention claimed is:

1. A device for automatically controlling edges of a web of sheeting, comprising:

a first deflecting roller and a second deflecting roller arranged next to each other in an axial direction in such a way that the web of sheeting travels widthwise over at least one section of each of the first and second deflecting rollers;

at least one drive for shifting the first and second deflecting rollers in opposite axial directions, including towards each other and away from each other;

a sensor for detecting a position of the web of sheeting;

a means for changing a ratio between a friction of the web of sheeting on the first deflecting roller and a friction of the web of sheeting on the second deflecting roller; and an automatic control device for controlling the at least one drive for shifting the first and second deflecting rollers in opposite axial directions and for controlling the means for changing the ratio between the friction of the web of sheeting on the first deflecting roller and the friction of the web of sheeting on the second deflecting roller based on the position of the web of sheeting detected by the sensor;

the device operable in a first mode wherein the automatic control device shifts the web of sheeting in a first direction towards the first roller through a combination of a) moving the first and second deflecting rollers away from each other while the ratio of friction is such that the friction between the web of sheeting and the first roller is greater than the friction between the web of sheeting and the second roller, and b) moving the first and second deflecting rollers towards each other while the ratio of friction is such that the friction between the web of sheeting and the second roller is greater than the friction between the web of sheeting and the first roller.

2. The device according to claim 1, wherein the first and second deflecting rollers are supported on a shaft, which comprises a first thread in an area of the first deflecting roller and a second thread in an area of the second deflecting roller, wherein the first thread and the second thread turn in opposite directions, and wherein the at least one drive for shifting the first and second deflecting rollers in opposite axial directions drives the shaft.

3. The device according to claim 1, wherein the means for changing the ratio between the friction of the sheeting on the first deflecting roller and the friction of the sheeting on the second deflecting roller comprises first and second pressure rolls, the first pressure roll serving to press the sheeting against the first deflecting roller, and the second pressure roll serving to press the sheeting against the second deflecting roller.

4. The device according to claim 3, wherein the first pressure roll is shiftable in the axial direction simultaneously with the first deflecting roller, and the second pressure roll is shiftable in the opposite axial direction simultaneously with the second deflecting roller.

5. The device according to claim 4, wherein the first pressure roll is connected to the first deflecting roller in such a way that the at least one drive for shifting the first and second deflecting rollers in opposite axial directions can shift the first pressure roll simultaneously with the first deflecting roller, and the second pressure roll is connected to the second deflecting roller in such a way that the at least one drive for shifting the first and second deflecting rollers in opposite axial directions can shift the second pressure roll simultaneously with the second deflecting roller.

6. The device according to claim 1, further comprising at least one additional sensor for detecting end positions of a travel of each of the first and second deflecting rollers, wherein the additional sensor is connected to the automatic control device.

7. The device according to claim 1, wherein the device is operable in a second mode wherein the automatic control device shifts the web of sheeting in a second direction towards the second roller through a combination of a) moving the first and second deflecting rollers away from each other while the ratio of friction is such that the friction between the web of sheeting and the second roller is greater than the friction between the web of sheeting and the first roller, and b) moving the first and second deflecting rollers towards each other while the ratio of friction is such that the friction between the web of sheeting and the first roller is greater than the friction between the web of sheeting and the second roller.

* * * * *